United States Patent [19]

Nakamura et al.

[11] Patent Number: 4,821,753

[45] Date of Patent: Apr. 18, 1989

[54] APPARATUS FOR CLEANING OF COUPLER ELEMENTS

[75] Inventors: Hideo Nakamura; Toshiharu Miura, both of Ichihara; Kazuhiro Kikkawa, Manazuru, all of Japan

[73] Assignees: Sumitomo Chemical Company Limited, Osaka; Sumitomo Chemical Engineering Co., Ltd.; Nippon Valqua Kogyo Kabushiki Kaisha, both of Tokyo, all of Japan

[21] Appl. No.: 102,640

[22] Filed: Sep. 30, 1987

[30] Foreign Application Priority Data

Oct. 2, 1986 [JP] Japan ..... 61-235303
Oct. 24, 1986 [JP] Japan ..... 61-253491

[51] Int. Cl.[4] ..... B08B 3/02

[52] U.S. Cl. ..... 134/59; 134/151; 134/199; 134/200

[58] Field of Search ..... 134/99, 199, 200, 170, 134/151, 59

[56] References Cited

U.S. PATENT DOCUMENTS 2,948,004 8/1960 Shields ..... 134/99 X
3,986,710 10/1976 Day et al. ..... 134/199 X

FOREIGN PATENT DOCUMENTS 383478 9/1973 U.S.S.R. ..... 134/199

*Primary Examiner*—Harvey C. Hornsby
*Assistant Examiner*—Stephen F. Gerrity
*Attorney, Agent, or Firm*—Wenderoth, Lind & Ponack

[57] ABSTRACT

A machine for cleaning a coupler consisting substantially of a male coupler element and a female coupler element, especially mating surfaces related parts thereof is proposed for avoiding fouling thereof in advance of practical coupling of both the elements. The machine is provided with a ring tube type cleaner unit suspended from a detachable top cover of a cleaning box. The inside space of the ring tube constitutes a liquid chamber supplied with cleaning water from a source and delivers from a number of nozzle openings formed through the inner wall of the ring tube, for delivery of sweep water jets in the center of the ring tube, where the tip and to-be-coupled ends of both the coupler elements are positioned at a small mutual distance. After cleaning jobs, either one of the male and female coupler elements is advanced to mating position for establishing a tight contact with the other one of the coupler elements for avoiding otherwise frequently encountered, disadvantageous fouling.

16 Claims, 7 Drawing Sheets

APPARATUS FOR CLEANING OF COUPLER ELEMENTS

BACKGROUND OF THE INVENTION

1. Field of the Art

This invention relates generally to improvements in and relating toa pparatuses for cleaning of coupler elements. More specifically, it relates to clean-quick couplers for use in serving for transfer of high purity chemical liquid as used in semiconductor production, from stationary storage containers to conveyor vessels on transporting vehicles, such as automotive trucks, and reversely therefrom to thsoe for ready-for-consuming.

2. Prior Art

As is well known, in the course of production of semiconductor elements and units, various high purity chemical liquors, to be referred to briefly as "chemical liquor" or "chemical liquors" throughout the present specification and in appended claims only for convenience are used in etching and the like processing jobs. These chemical liquors are manufactured at chemical factories and then transferred from the manufacturer's storage tank and transported in provisional containers on road truck, railroad wagon and freight car or marine vessel, to consumer's storage tank, preferably of semiconductor manufacturers.

In this case, a connecting piping is used for transfer of the chemical liquor from the manfuacturer's storage tank to provisional transport container. This kind of piping is fitted at both the ends thereof with bolted flange-fittings for establishing leak-proof conenction with the related tank and container. At the transport terminal, similar connecting measures must naturally be employed. Frequently, the bolted flange fittings of the above kinda re replaced by union couplings. The chemical liquids to be used, especially int eh manufacture of semi-conductor elements or units, are most carefully and precisely controlled in its quality and purity, and thus occasional and careless fouling must be prevented with utmost attention during transfer and transport.

With use of the above-mentioned bolted flange- and union joints, foreign fouling matters will invade into the chemical liquors during handling thereof. In addition, in that case, pipe-conenction job disadvantageously consumes rather long and troublesome handling time to a considerable degree.

SUMMARY OF THE INVENTION

It is therefore an object of hte present invention to provide a cleaning apparatus capable of avoiding aforementioned disadvantages.

A further object of the invention is to provide an improved cleaning apparatus capable of cleaning off fouling substances frequently appearing at the conjointing and mating surfaces of male and female coupling elements directly before execution of the coupling job of the matingly coupling elements.

A still further object is ot provide an improved cleaning apparatus allowing to couple the male and female elements at an extremely clean state.

In order to fulfill the foregoing objects, features and advantages of the invention, the inventive apparatus for cleaning a coupler substantially consisting of a male coupler element and a female coupler element, capable of being coupled together especially at mating surfaces thereof, comprises: a cleaning box having a bottom, four side walls rigid with said bottom, and a detachable top cover moutned on tops of said side walls; a pair of oppositely provided coupler insertion openings formed through a pair of said side walls, for introducing the female or male coupler element and for introducing and substantially fixedly mounting the other one of the coupler elements, respectively; a cleaning chamber formed within said cleaning box; an annular cleaning means coaxially encircling with idle gaps said mating surfaces slightly separated from each other when said both coupler elements are positioned nearly and coupled positions; a number of nozzle openings formed on said cleaning means and directing substantially towards radial center of the latter; means to feed pressure water to said cleaning means for forming a number of water jets for washing said separated mating surfaces of both the coupler elements; means for attaching said male coupler element to said cleaning box; and pressure means for advancing further inwardly said female coupler element towards said male coupler element until both the coupler elements are brought into mutually and tightly mating and coupled relative positions.

Since, according to the present invention, the surfaces to be mated, together with neighboring portions thereof, of the male and female coupling elements are, in direct advance ofthe real and aimed-at coupling of both the elements, to a liquid cleaning operation with a nubmer of strong water jets issuing from a large number of nozzle openings formed on the ring-formed cleaner means, directing towards the center thereof, where substantial and related parts of the coupling elements are positioned at a small mutual distance, and, therefore, dusts and foreign fouling matters, even attached to the coupler surfaces are prevented from invading into the inside of the connection piping and, thus, pure and clean chemical liquor can be transferred from the storage tank to the containers and vice versa. Additionally, the male coupling element is fitted with a flange which is designed and arranged to cooperate with coupler-fixing means fitted on the cleaning box, so as to fix the male coupler element thereto, in a simple and rapid manner, thereby the oeprating efficiency being highly improved.

DETAILED DESCRIPTION OF THE INVENTION

Figure 1:
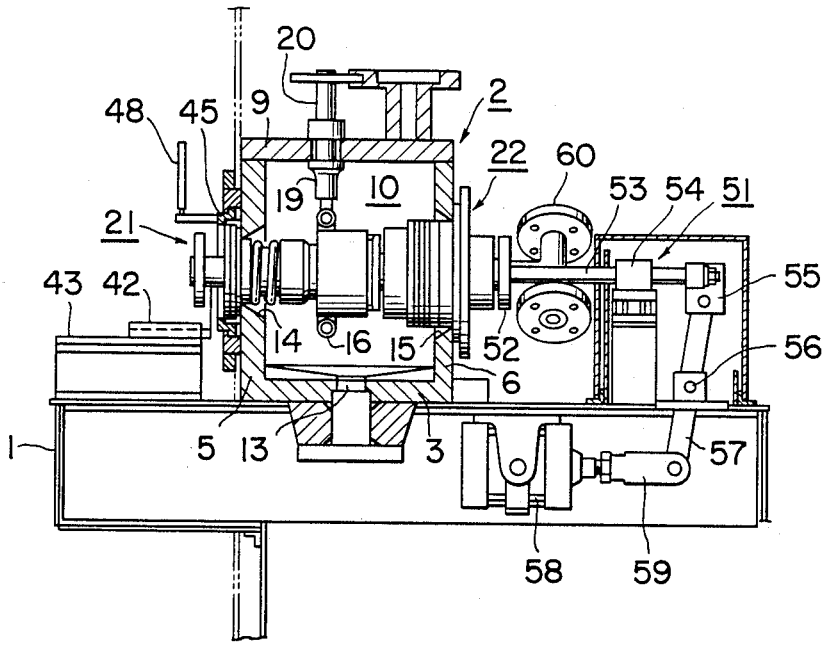
FIG. 1 is a sectional elevation of a preferred embodiment of the inventive apparatus for the cleaning of male and female coupler elements.

In FIG. 1, numeral 1 represents a machine bed or mounting structure, on which a cleaner box 2 is fixedly mounted. This box consists generally of bottom wall 3, four side walls 5, 6, 7 and 8 and top cover 9, defining an inside cleaning chamber 10. Front and rear side walls 7, 8 are shown specifically in FIG. 2. As seen from FIGS. 1 and 2, the bottom and four side walls are rigidly conencted with each other, while the top cover 9 is detachably connected, although such a specific structure is not limitative to the invention.

Figure 2:
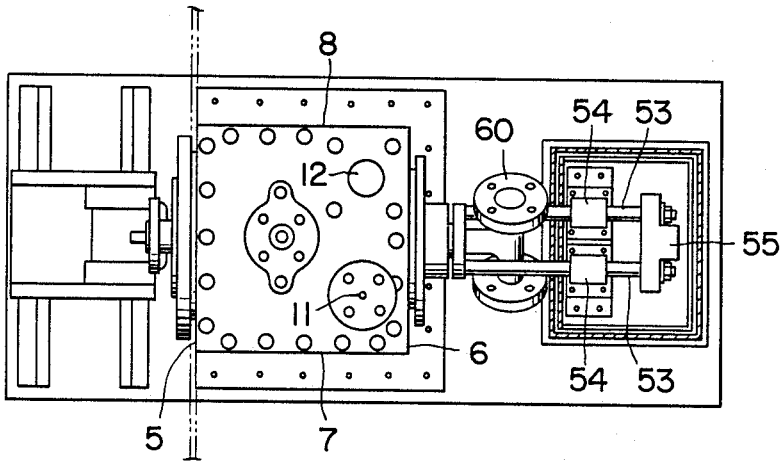
FIG. 2 is a top plan view thereof.

The top cover 9 is formed with a pressure air inlet opening 12 and a gas purger outlet opening 11, as shown in FIG. 2. The inlet opening 12 serves for the introduction of sweeping air, while the outlet opening 11 serves for discharge of foul gases developed during the clenaing operation. On the other hand, bottom wall 3 is formed with an outlet opening 13 serving for discharge of drain liquid from cleaner chamber 10. The opposite side walls 5 and 6 are formed with respective coupler element insertion openings 14 and 15, as shown in FIG. 1.

Figure 3:
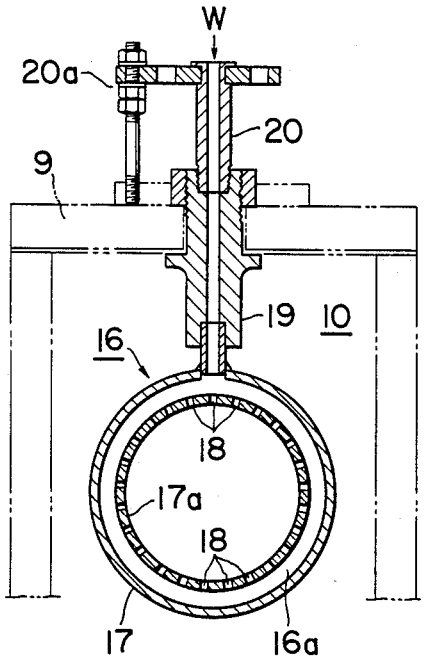
FIG. 3 is a sectional elevation of a spray ring unit and several related parts thereof, as adopted in the present embodiment, and in a somewhat enlarged view from the foregoing.

As more specifically illustrated in FIG. 3, a spray ring 16 in form of a hollow ring tube 17 is provided within the cleaner chamber 10, although it is shown in FIG. 1 only schematically. As seen, the inner wall 17a of this hollow ring tube 17 is formed with a plurality of nozzle openings 18.

The inside ring space 16a of this spray ring 16 is conencted, through a hollow mouth piece 19 mounted on the top cover 9, with a water supply pipe 20, and thus in a suspended manner. The water supply pipe 20 is adjustably mounted on the top cover by means of a support unit 20a and conencted to a proper water supply source, only schematically shown by a reference character W.

It will be seen, therefore, that when cleaning water is supplied under pressure from the source W through supply pipe 20 and mouth piece 19 to spray ring 16, cleaning water jets are delivered from nozzle openings 18.

Through the introduction opening 14 of cleaner box 2, male coupler 21 has been introduced into position, whereas through the opposite introduction opening 15, female coupler 22 has been introduced into position. This female coupler 22 is fixedly attached to cleaner box 2 by means of a plurality of fixing bolts, not shown. In this position, female coupler 22 extends slightly through the inside space defined by the spray ring 16. In practice, male coupler 21 is introduced through insertion opening 14 from outside and held with slight clearance from the front end surface of the female coupler 22.

In the following, detail structure of male and female coupler elements 21, 22 will be illustrated more in detail with reference to FIGS. 4 and 5, respectively. However, it should be noted that the invention is not limited to such detailed structure per se.

Figure 4:
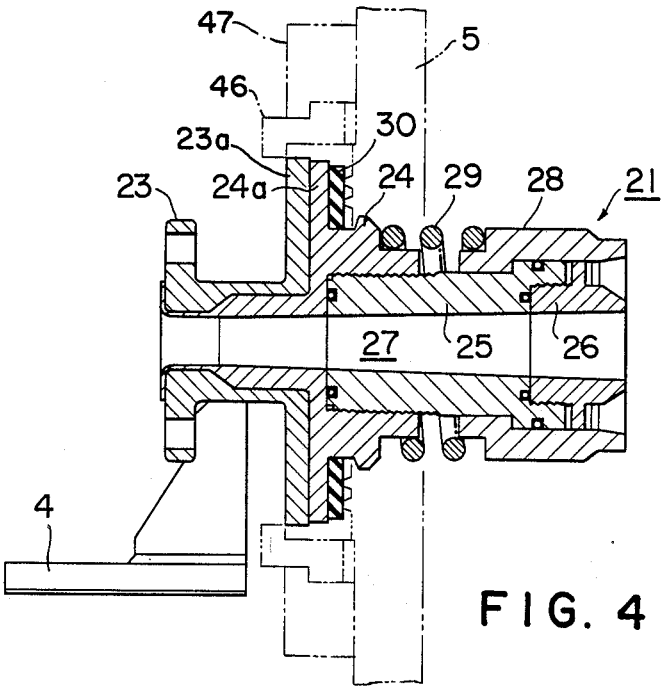
FIG. 4 is an enlarged sectional elevation of the male coupler element and several related parts thereof.

Male coupler element 21 comprises, as shown in FIG. 4, a connecting flange 23 a main hollow body 24 and a guide hollow piece 25 screw-coupled with each other into a rigid unit, the latter being further provided with a hollow chip 26 again screw-coupled therewith.

It is preferable to make all these main hollow piece 25 and hollow chip 26 with chemical-proof substance, such as, rather preferably tetrafluoroethylene resin. The foregoing three members 24, 25 and 26 have a coaxial common bore 27 having a generally and forwardly larger cross-section and thus providing a gradually tapered axial fluid flow passage. On the shouldered peripheral surface of guide hollow piece 25 is slidably mounted a packing gland 28 which is subjected to a forwardly directing pressure force under the action of coil spring 29. Main hollow body 24 is formed with a radial flange 24*a* which is coacting with the outer surface of side wall 5, and indeed, through the intermediary of a gasket 30.

Figure 5:
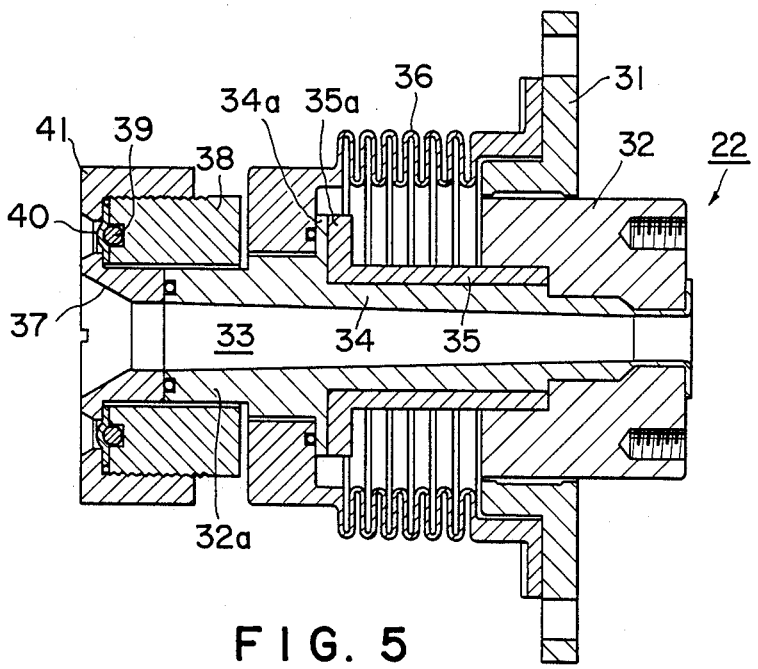
FIG. 5 is an enlarged sectional elevation of the female coupler element employed in the embodiment.

Female coupler element 22 comprises as shown in FIG. 5, a conencting flange member 31, a hollow socket member 32 and a hollow inside member 34 having a centrally extending and slightly tapered fluid passage bore 33. The outer surface of inside member 34 is stepped at several positions, of which the largest one being denoted with 34*a*. A flange sleeve 35 is mounted on the outside surface of the member 34, the flange 35*a* of the former abutting on the shoulder step 34*a* for assuring relative positioning therebetween.

Between connection flange 31 and hollow inside member 34, bellows 36 are inserted, while, at the tip end of the member 34, a tip socket 37 is connected, so as to couple with the hollow chip 26 of the oposite male coupler element 21. At the outside of tip end 32*a* of hollow inside member 34 and the tip socket 37, a male-threaded, packing support member 38 carrying at the front ring surface thereof a combination of O-ring 39 and a gasket 40 is provided, all these members being held in positoin by a female threaded gasket retainer 41.

The foregoing male coupler element 21 is preferably supported on a slidable bolster or rest 42, FIG. 1, which is movably mounted on a stationary rail member 43.

Figure 6:
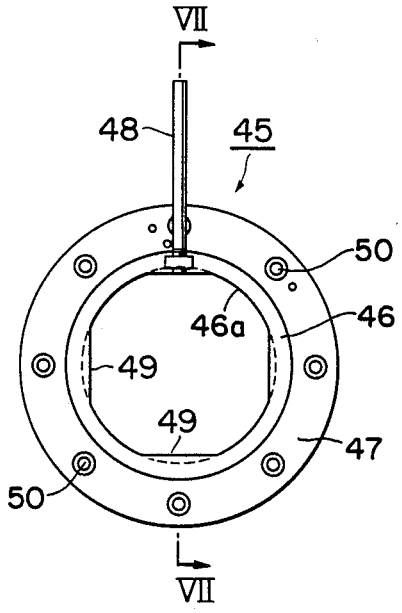
FIG. 6 is an enlarged coupler-fixing means shown in FIGS. 1 and 2.
Figure 7:
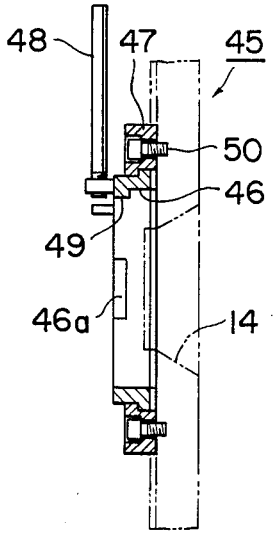
FIG. 7 is an axial section of the coupler-fixing means taken along a section line VII—VII shown in FIG. 6.
Figure 8:
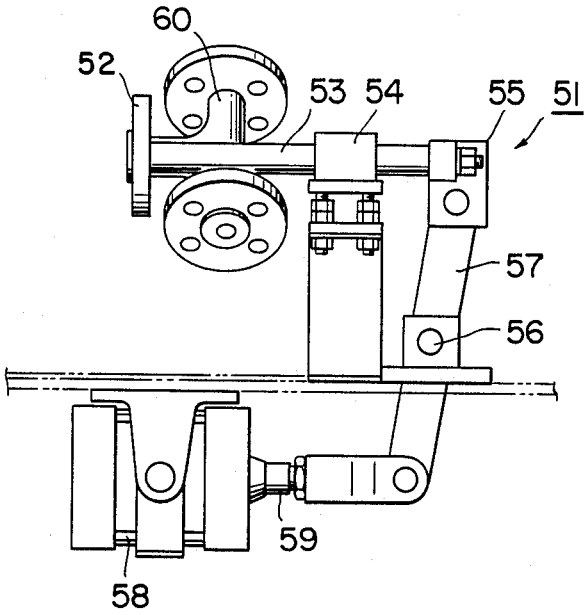
FIG. 8 is a somewhat enlarged side elevation of a coupler-pressurizing means shown in FIG. 1.
Figure 9:
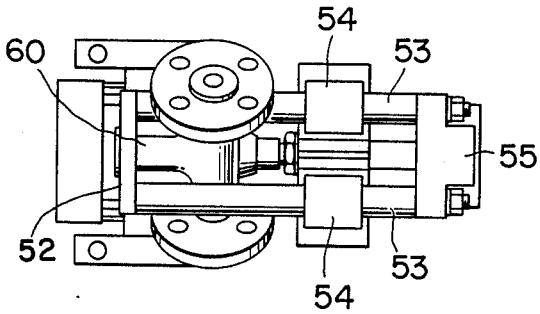
FIG. 9 si a top plan view of the couplerpressurizing means shown in FIG. 8.
Figure 10:
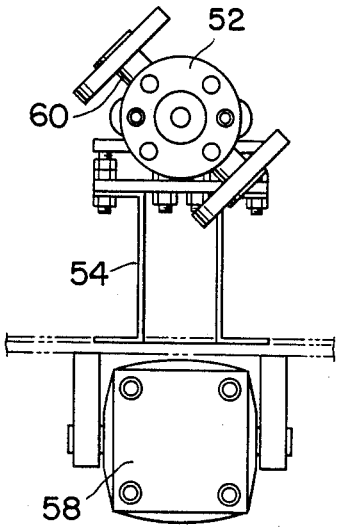
FIG. 10 is a front view thereof.

As seen in FIG. 1 generally and more specifically in FIGS. 6 and 7, there is provided a coupler fixer unit 45 for fixingly positioning the male coupler element 21 after insertion of the latter through insertion opening 14 into the cleaner box 2. This unit 45 comprises an inside ring 46 and an outside ring 47. The inside ring 46 is coupled with the outside ring 47 by means of shoudlered mating surfaces in a slip-out proofing manner. In addition, inside ring 46 is arranged rotatable by manipulation of a handle 48.

Along the inside peripheral edge of inside ring 46, defining the inner open space thereof, there are provided equidistantly with four engageable edge portions 49 solid with the ring. Through the inside open space above-mentioned, the conenction flange 23 of male coupler element 21 can be introduced. It should be noted that by turning the inside ring 46 by 45-degrees or so, the engageable edge portions 49 act upon the coupler element 21 relative to the cleaner box 2, as will be set forth hereinafter more in detail. Further, outer ring 47 is formed with a plurality of mounting holes so as to attach to the side wall 5 by means of bolts 50.

Still further, at the righthand side of female coupler element 22 in FIG. 1, a pressure drive unit 51 is provided for propelling the movable parts of the element 22 toward the opposite male coupler element 21 to bring both the elements into tight contact with each other. The detailed structure of the unit 51 is shown in FIGS.

8–10. In this unit 51, there are provided a pair of parallel-arranged conenction shafts or rods 53 which are conencted by one-side ends with liquid take-out pipe means 60. These connection shafts 53 are slidably supported by respective pedestals 54. At the opposite ends of the shafts 53, a crosshead 55 is conencted which is operatively connected with the actuating end of a rocking arm 57, while the opposite end is connected to operating end of a piston rod 59 of a pressure air cylinder 58.

The operation mdoe of the first embodiment of hte invention, shown in FIGS. 1 - 10, is as follows:

The female coupler element 22 is held, in advance, in fixed position to the cleaner box 2, as shown and described in and with FIG. 1. In this case, the tip end of the element 22 extends into the range of spray ring 16. On the other hand, the male coupler element 21 is mounted on the slidable bolster 42 and introduced through the related introduction opening 14 substantially into cleaner chamber 10. During this inserting operation, the connection flange 23 of male coupler element 21 is inserted into inside open space 46*a* of the inside ring 46. Then, handle 48 is turned to a certain angle by hand, so that two pairs of engageable straight edges 49 squeeze the ocnnection flange 23. At this operation stage, the front end of hollow tip or chip piece 26 of male coupler element 21 is halted in position in proximity of tip or chip socket 37 of female coupler element 22.

Then, pressure water is fed from a supply source, indicated with W in FIG. 3, through tube member 20 and hollow mouth piece 19 to the inside space of spray ring 16 to feed the cleaning water in the form of radial jets through the nozzles 18 (shown only schmeatically and partially) towards the portions, later to be coupled together, of the both coupler elements 21 and 22, for the execution of a sufficient cleaning job. The fouled or waste water is then discharged to outside, through a discharge outlet 13 kept in communication with cleaning chamber 10 passing through the bottom wall 3.

Further, then, air cylinder unit 58 is brought into operation, so as to drive its piston rod 59 forward for turning a rocking arm 57 in counterclockwise direction in FIGS. 1 and 2 around a pivot pin 56 thereof. By this pivotal movement of the arm 57, a connecting rod 53 slidably guided by a stationary pedestal 54, which is fixedly provided at its tip end with an actuating flange 52, is pushed forward in the lefthand direction in Figs. 1 and 8, thereby the hollow member 32 of female coupler element 22 with the actuating flange 52 being moved forward, together with the hollow and inner main member of the female coupling element 22. While the bellows 36 is subjected to expansion and at the same time, the female coupler element 22 is also moved, as a whole, in the forward direction towards realization of a complete mechanical coupling state between the male and female coupling elements. At the final stage, the chip socket 37 is brought into tight contact with the chip 26 for completion of the coupling.

In the following, the second embodiment of the invention will be illustrated hereinbelow with reference to FIGS. 11–14.

Figure 11:
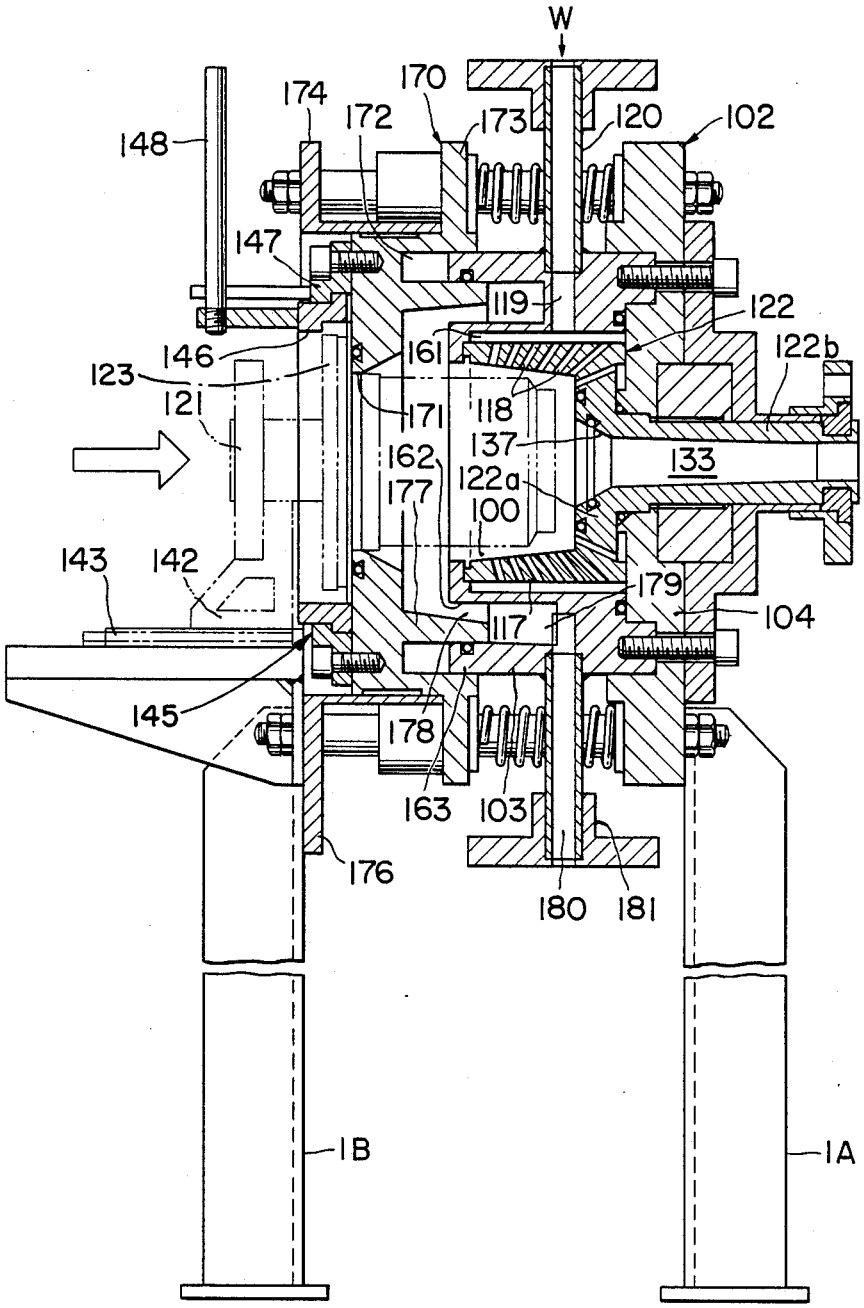
FIG. 11 is a sectional elevation of a second embodiment of the invention.
Figure 12:
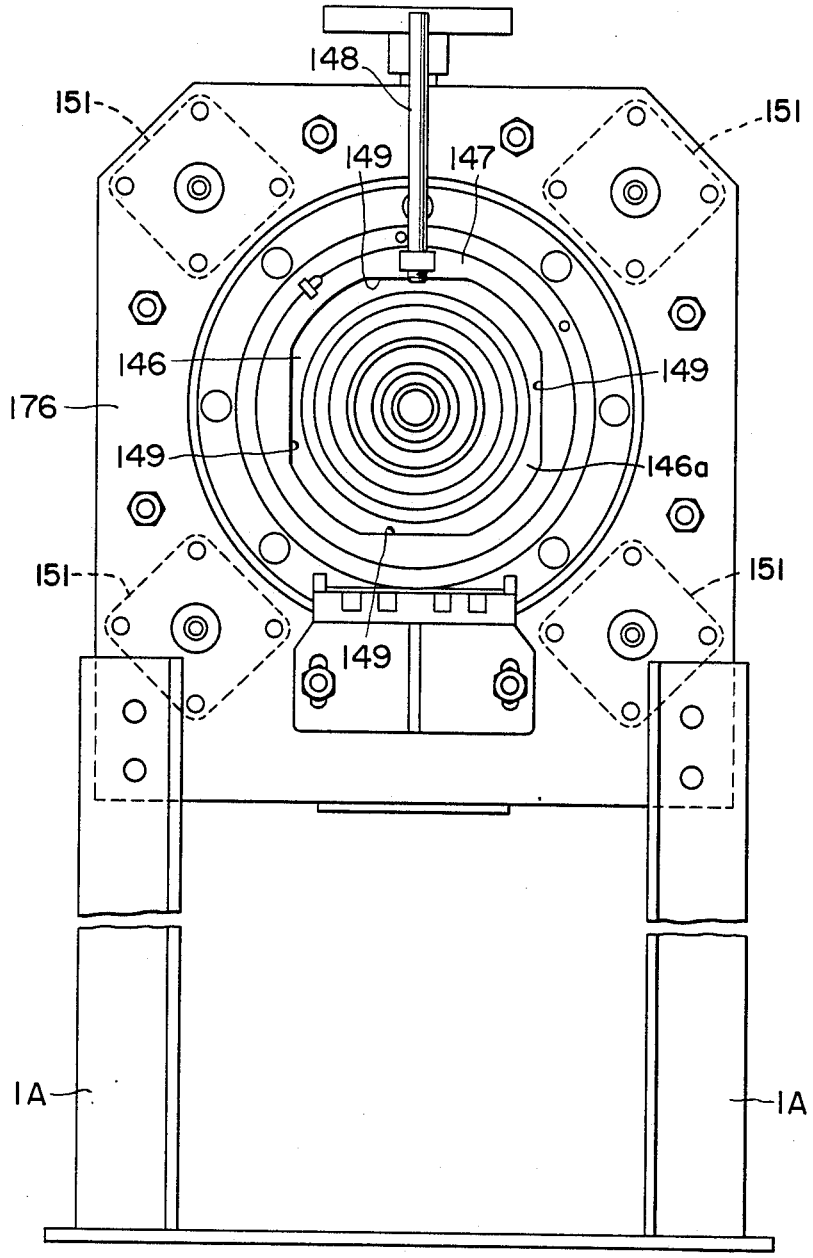
FIG. 12 is an end view of the embodiment of FIG. 11, when seen from the lefthand side of FIG. 11.

In FIG. 11, reference symbols 1A and 1B represent four mounting sections which constitute, in combination, a single mounting structure, supporting rigidly a clenaer box 102. This cleaner box comprises a substantialloy cylindrical wall casing 103 and end wall portions 104, representing therein a cleaner chamber 100. In this chamber 100, main portion of a female coupler element 122 is composed substantially of a coupler head 122*a* and a stem portion 122*b* made solid with each other, the latter portion being mounted in position on one of said end walls 104. Spray ring 117 is made solid with the peripheral portion of the coupler head in a concentric manner and as a projection extending in parallel to the common axis of said coupler head 122*a* and stem portion 122*b*. The spray ring 117 is formed with a number of water injection nozzles 118. As shown, the stem portion 122*b* is formed axially therethrough with a liquid passage bore 133. At the inner end of the passage bore, there is provided a tapered valve seat surface 137. Further, along and at the outside surface of spray ring 117, there is provided a ring-shaped liquid reservoir chamber 161, which is so designed and arranged to be fed with cleaning liquid through a liquid supply pie 120 and a connection passage 119.

On the other hand, the cylindrical wall 103 of the cleaner box or chamber is formed with a ring recess 162 made open at one side thereof and having a predetermined depth. The outside periphery of ring recess 162 defined by a guide wall 163 is caught by or coupled with a mounting or positioning slider 170 in a squeezed manner so to speak. The positioning slider 170 is formed with an insertion opening 171 for male coupler element 121, a guiding recess 172 and a radially and outwardly projecting flange 173. The slider 170 is guided within the inside of a support frame 174 to slide in the axial direction of the coupler. Support frame 174 is provided with an attaching flange 176 which is fixed to the mounting frame portion 1B.

Guiding recess 172 of the slider 170 is kept in slidable engagement with a guide wall 163 at the cleaner box side in an capped manner and a cleaning liquid discharge passage 178 is defined partly and formed. This discharge passage 178 is kept in connection with the passage 179 appearing at the clenaer box side so that the fouled liquid may be discharged therefrom through discharge outlet 180 and discharge passage 181 to the outside.

At the lefthand end surface of positioning slider 170 in FIG. 11, there is fixing means 145 for the male coupler element 121. The fixing means 145 is composed of an inside ring 146 and an outside ring 147. The inside ring 146 and outside ring 147 are kept in a mutually coupled engagement through teh intermediary of mating shoulders, the inside ring 146 being rotatable by manipulation of an attached handle 148.

The inside ring 146 has naturally an inner open space 146*a* at the periphery thereof being provided integrally with four spaced engageable portions 149 which may be formed into respective engageable pawls or the like. Through the said inner open space 146*a*, the connection flange 123 of male coupler element 121 may be introduced. Upon completion of such insertion, the insdie ring 146 is turned substantially by 45 degrees, so as to bring said engageable portions 149 into fixed engagement for establishment with the male coupler element 121, thereby the latter being fixed in position relative to the cleaner box 102.

It is rather preferable to support the male coupler element 121 on a slider block or bolster 142, which is slidably mounted on rail or rails 143 on the mounting frame 1.

Figure 13:
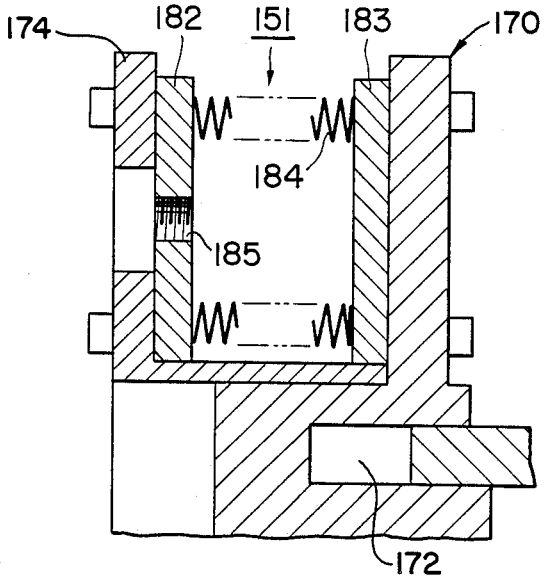
FIG. 13 is an enlarged and detailed sectional view of one of positioning slider-forward push units shown in FIG. 12.
Figure 14:
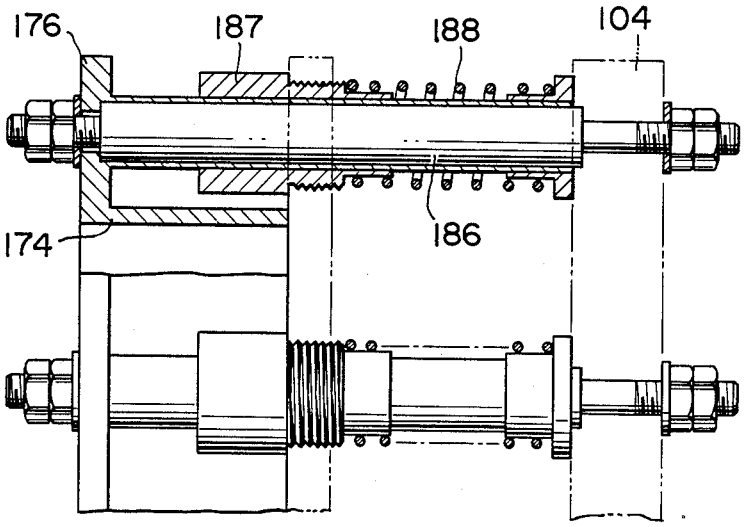
FIG. 14 is an enlarged and detailed view of a positioning slider-returning unit only partially shown in FIG. 12.

Between support frame 174 and slider 170, there are provided four sets of pushers 151 which are adapted for moving the mounting slider within a predetermined maximum stroke and in the direction parallel to the longitudinal axis of the ocupler. These pusher units 151 are arranged in quadruple along an imaginary circle, as may be well seen in FIG. 12. Each of these pushers 151 comprises, as shown in FIG. 13, a separated pair of end plates 182 and 183 and bellows 184 arranged therebetween. One of said end plates, preferably that shown at 182, is formed with an inlet port 185. By introducing pressure fluid, these bellows 184 will expand as conventionally.

Further, between the end wall 104 and the flange 176 of support frame 174, there are provided a plurality of connection shafts 186. These shafts 186 penetrate through the outside flange 173 of positioning slider 170, a sleeve member 187 being fixedly attached to the penetrating portion of each of the shafts 186. Return spring 188 is provided on each of these shafts and between one end of the sleeve member 187 and the related one side wall of the cleaner box. The spring force at 188 urges resiliently the slider 170 leftwards in FIG. 11, thus in decoupling and releasing sense.

The operation mode of the foregoing second embodiment of inventive cleaner machine is as follows:

As referred to hereinbefore, the female coupler 122 has been fixed to cleaner box 102 and spray ring 117 is arranged with its spray nozzle openings 118 kept open, as is illustrated in FIG. 11.

The male coupler element 121 is mounted on slidable bolster 142 and introduced through insertion opening 171, until its tip end invades into the interior space of spray ring 117. In this inserting operation, the connection flange **121*a* of male coupling element 121 is introduced into the inside ring space 146*a* of inside ring 146 as shown. Upon gripping of a handle 148, fixedly attached to outer ring 147, by the operator's hand for turning the latter by a certain angle, four engageable portions 149 or more specifically gripping edges will grpi the connection flange 123 in a squeezing manner firmly at two pairs of contacting points. In this operating stage, the tip end of male coupler element 121 has been halted in close proximity of the valve seat 137 of female coupler element 122, as shown in FIG. 11**.

Then, pressurized cleaning water is fed from a water supply source indicated at W in FIG. 11 through supply pipe or conduit 120 and conenction passage 119 to liquid reservoir chamber 161, thence further to spray ring 117, for directing cleaning water jets through nozzle openings 118 thereof towards the male coupler element 121. With application of these water jets, the coupling portions of these elements are subjected to sufficient cleaning operation. The resulted fouled water will be conveyed through passages 178 and 179 to the discharge outlet 180, thence through discharge pipe or conduit 181 to the outside.

Then, operating liquid is fed through inlet port 185, FIG. 13, into the bellows 184 for causing the latter to expand. In this way, positioning slider 171 is forced to advance for the execution of a mechanical coupling job between male coupler element 121 and female coupler element 122.

For disengaging the male coupler element 121 from female coupler element 122, it is only necessary to allow discharge of the operating fluid, preferably oil, from within the interior of the bellows 184. Then, the return springs 188 will exert urging forces upon the bellows for contracting the latter.

What is claimed is:

1. An apparatus for cleaning a coupler of the type having a male coupler element and a female coupler element, the male and female elements each having mating surfaces and each being capable of being coupled together especially at the mating surfaces thereof, said apparatus comprising:

a cleaning box having a pair of spaced opposed side walls for defining a cleaning chamber;

a pair of spaced opposed coupler element insertion openings, one each of said pair of openings being in one of said pair of side walls of said clenaing box for allowing one each of the male and female copuler elements to be introduced into said cleaning chamber therethrough;

means for attaching one of the male and female coupler elements to said cleaning box and in one of said pair of insertion openings for positioning the mating surfaces of the one of the male and female couplers within said cleaning chamber;

means for holding the other one of the male nad female coupler elements and for inserting the other one of the male and female coupler elements through the other one of said coupler element insertion openings for bringing the other one of the male and female coupler elements directly adjacent and spaced from the one of the male and female coupler elements attached to said cleaning box for defining an idle gap bewteen the mating surfaces of the male and female coupler elements;

an annular cleaning means in said cleaning chamber for coaxially encircling the mating surfaces of the male nad female coupler elements and the idle gap between the mating surfaces ;

a plurality of nozzle openings in said annular cleaning means for directing a fluid substantially towards the radial center of said annular cleaning means for cleaning the adjacent and spaced apart mating surfaces of the male and female coupler elements;

means for feeding pressurized water to said plurality of nozzle openings for forming a nubmer of water jets for washing the adjacent and spaced apart mating surfaces of both the coupler elements; and pressure means for advancing further inwardly the other one of the male and female coupler elements held by said holding means towards the one of the coupler elements held by said attaching means until both coupler elements are brought into a mutually and tightly mating and coupled position.

2. The apparatus of claim 1, wehrein said cleaning box is mountedon a mounting structure, said cleaning box comprising a bottom, four side walls integral with said bottom, and a detachable top cover mounted on the respective tops of said side walls, and said top cover having a pressure air inlet opening for introducing sweeping air, and said top cover having a gas purger outlet opening for discharging foul gases developed during cleaning of the coupler elements.

3. The apapratus of claim 2, wherein said annular cleaning means is suspended from said top cover of the cleaning box by means of suspending means, said suspending means including a water conducting means saving first and second ends, said first end being connectable to a water supply source, and said second end being connected to said annular cleaning means for supplying cleaning water thereto.

4. The apparatus of claim 3, wherein said suspending means includes a hollow mouth piece and a water supply pipe detechably connected with each other.

5. The apparatus of claim 1, wherein said cleaning box has an outlet opening for discharging waste liquid from said cleaning chamber.

6. The apparatus of claim 1, wherein said annular cleaning means is a ring tube, the inside space of said ring tube defines a liquid space for being supplieod with cleaning water by said pressurized water feeding means, and said nozzle openings are through holes in the inner wall of said ring tube.

7. The apparatus of claim 1, wherein said means for attaching either one of the female and male coupler elements to said cleaning box has a means for attaching a male coupler element to said cleaning box for positioning the mating surfaces of the male coupler element within said cleaning chamber.

8. The apparatus of claim 7, wherein said male coupler element attaching means includes an outer ring member fixedly secured to said cleaning box and adjacent one of said pair of coupler element insertion openings, an inside ring member is rotatably coupled in said outerring member and has on its inside periphery a plurality of engageable portions for collectively gripping the outer peripheral surface of a male coupler element.

9. The apparatus of claim 1, wherein said pressure means includes a rocking arm pivotably mounted substantially at its central portion, a pressure air cylinder, an operating end thereof being mechanically connected with one end of said rocking arm, a conencting bar having a first end mechanically coupled with the opposite end of said rocking bar, and a second end of said conencting bar being mechanically connectable to a flange portion of a liquid take-out tube for a female couple element.

10. The apparatus of claim 1, wherein said annular cleaning means includes a hollow spray ring projecting integrally from the front end surface of said female coupler element, and a number of spray nozzle openings bored through a peripheral wall of said spray ring.

11. The apparatus of claim 10, wherein a ring-shaped liquid space is formed around an outer periphery of said spray ring and kept in fluid communication with a cleaning water supply passage.

12. The apparatus of claim 1, wherein said cleaning box comprises a substantially cylindrical wlal casing and end wall portions, said cleaning chamber being constituted therein, and a main portion of a female coupler element being composed substantially of a coupler head and a stem portion made solid therewith.

13. The apparatus of claim 12, wherein said spray ring is integral with a peripheral portion of the coupler head in a concentric manner, and as a projection extending in parallel to the common axis of the coupler head and the stem portion.

14. The apparatus of claim 1, further cmoprising a slider block slidably mounted on a stationary rail means structure, said slider block having means for detachably mounting a male coupler element.

15. The apparatus of claim 14, wherein between said mounting means and said slider block, there are provided a plurality of sets of pushers for moving said slider within a predetermined maximum stroke and in a directional parallel to a longitudinal axis of a male coupler element detachably mounted on said mounting means.

16. The apparatus of claim 14, wherein said slider block is formed with a passage for discharging of waste liquid from said chamber.

* * * * *